United States Patent [19]

Milli

[11] 4,373,686

[45] Feb. 15, 1983

[54] SYSTEM FOR THREAD GUIDING IN WINDING MACHINES

[76] Inventor: Ottavio Milli, 17 Piazza Dante, Grosseto 58100, Italy

[21] Appl. No.: 98,239

[22] Filed: Nov. 28, 1979

[51] Int. Cl.[3] ..... B65H 54/28

[52] U.S. Cl. ..... 242/158.2; 242/25 R; 242/158.4 R

[58] Field of Search ..... 242/158.2, 158 R, 158.4 R, 242/25 R

[56] References Cited

U.S. PATENT DOCUMENTS

| | | | |
|---|---|---|---|
| 2,845,229 | 7/1958 | Bliss | 242/158.4 R X |
| 2,988,292 | 6/1961 | Bliss | 242/158.4 R X |
| 3,031,153 | 4/1962 | Attwood et al. | 242/158 R |
| 3,039,707 | 6/1962 | Beck et al. | 242/158.2 X |
| 3,498,567 | 3/1970 | Baker | 242/158.4 R |
| 3,507,458 | 4/1970 | Merchant et al. | 242/158.4 R |
| 3,544,035 | 12/1970 | Woolever | 242/158 R |
| 3,779,480 | 12/1973 | Cambou | 242/158 R |
| 3,833,184 | 9/1974 | Hara et al. | 242/158 R |
| 3,951,355 | 4/1976 | Morioka et al. | 242/158 R |
| 4,022,391 | 5/1977 | Stein | 242/158 R X |

FOREIGN PATENT DOCUMENTS

| | | | |
|---|---|---|---|
| 1267507 | 5/1968 | Fed. Rep. of Germany | 242/158 R |
| 1902722 | 10/1978 | Fed. Rep. of Germany | 242/158 R |
| 1042614 | 6/1953 | France | 242/158 R |
| 2022636 | 12/1979 | United Kingdom | 242/158 R |

*Primary Examiner*—Stanley N. Gilreath
*Attorney, Agent, or Firm*—Silverman, Cass & Singer, Ltd.

[57] ABSTRACT

A thread or wire is carried by a guide roller of a carriage along a path between a feed source and a winding spool. The carriage may be displaced in opposite directions at a regulated speed by a worm screw to overlay layers of turns on previously laid layers of turns in a regular arrangement of side by side turns. A lever pivoted on the carriage has a fork at one end. The fork is arranged between the guide roller and spool and the thread passes therethrough. The other, free end of the lever is situated between two switches or photocells detecting any pivoting of the lever. At one or the other ends of the spool, the angle or slant of the thread relative to the spool changes because the thread engages with the side walls of the spool. This pivots the lever, by way of the fork, and actuates one or the other of the two switches or photocells, which in turn causes a reversal of the displacement of the carriage. This achieves a regular, side by side arrangement of the turns as one layer is completed and the next layer is started. A blocking system including flanges which support the sidewalls of the spools is provided on the winding mechanism. The flanges have a diameter at least equal to the diameter of the spool side walls and provide a rim extending inwardly of the spool to engage the thread at the ends thereof.

9 Claims, 2 Drawing Figures

SYSTEM FOR THREAD GUIDING IN WINDING MACHINES

BACKGROUND OF THE INVENTION

It is known that to wind a thread or wire, both if it is arriving from a source spool having a large diameter or if it arrives from a source such as an extruder, it is necessary to guide the thread in its winding movement. Normally, the thread is guided by means of a guiding pulley and the thread displaces itself laterally across the spool with respect to an origin, as a function of the thickness of the series of turns which are arranged beside one another. Alternatively, the thread is guided by a mechanical device. If, for whatever reason the thread is not suitably and carefully guided, a superposition of the turns takes place, such as in the case of guiding devices having a mechanical distributor, i.e. an irregular winding of the thread upon the spool takes place. This is particularly true in the case of spools of metal wire which are intended for particular uses in industry, such as spools of wire for welding, in welding machines of the continuous thread type.

SUMMARY OF THE INVENTION

An object of the present invention is to provide improvements in thread guiding systems, said improvements furnishing in a safe, efficient and dependable way, the turn by turn winding of a thread or wire of any diameter, with reversal of the movement in such a way as to obtain successive layers of perfectly lined-up turns.

The improvements of the present invention concern obtaining faultlessly aligned and joined turns, by furnishing systems for displacing and guiding the thread during its winding upon a spool, as well as means for ascertaining the position of the thread in such a way to be able to determine with precision the exact instant at which the reversal of the movement of the thread must take place in order to achieve the superposition of a layer of turns upon a preceding layer.

According to the invention, a guiding member for the thread is displaced gradually and at a regulated speed which is pre-established as a function of the speed of rotation of winding and of the diameter of the thread. Means of the lever type are used to determine the instant at which the reversal of the thread guiding member must take place and to keep constant the angle between the thread and spool so that the faultless winding of the turns is achieved.

The function of a distributor can be effected through mechanical means of the lever type, wherein the lever by means of a cushioned wheel will follow the whole range of displacements of the thread on the spool, correcting for any slanting of the thread by means of a braked lever.

The winding machine is equipped with a blocking system having flanges. The flanges have a diameter which is at least equal to, and not less than, the diameter of the flanges of the spool or reel. The flanges of the blocking system are engaged with the flanges of the spool so that the flanges of the spool are stiff enough to represent a valid point of reference for the reversal of the slant of the thread relative to the spool, when a layer of turns has been completed.

According to a particular solution, the flanges of the blocking system are provided on anchoring members and the flanges can house the thickness of the flanges of the spool, so that at the moment of reversal of the slant of the thread, the thread comes into contact with the flange of the anchoring member and not with the flange of the spool. In effect, the flanges of the spool, which may be formed of a plastic material, for instance P.V.C., do not represent a valid reversal point for the slant of the thread, since they are relatively resilient and furthermore they are subject to wear because of the constant contact with the thread.

Furthermore, a point of contact between the thread and a fixed point on the flange of the anchoring member is needed at the moment of the reversal of the slant. This point of contact provided by the flange of the anchoring member appears to be remarkably more stable and, therefore, more apt.

In order to facilitate winding and to avoid possible sudden stresses in the thread which could cause the breaking of the thread itself, a shock absorbing device is provided. This is a suitable type device formed by a composite system of shock absorbers, of the spring, pneumatic or hydraulic type, which controls the motor of the thread uncoiler, the electronic driving system of which is of the reversible, regulated-speed, type.

BRIEF DESCRIPTION OF THE DRAWING

The invention will be better understood from the reading of the following description, considered with reference to the schematic enclosed drawing, in which, in a purely indicative way.

DESCRIPTION OF THE PREFERRED EMBODIMENT

Figure 1:
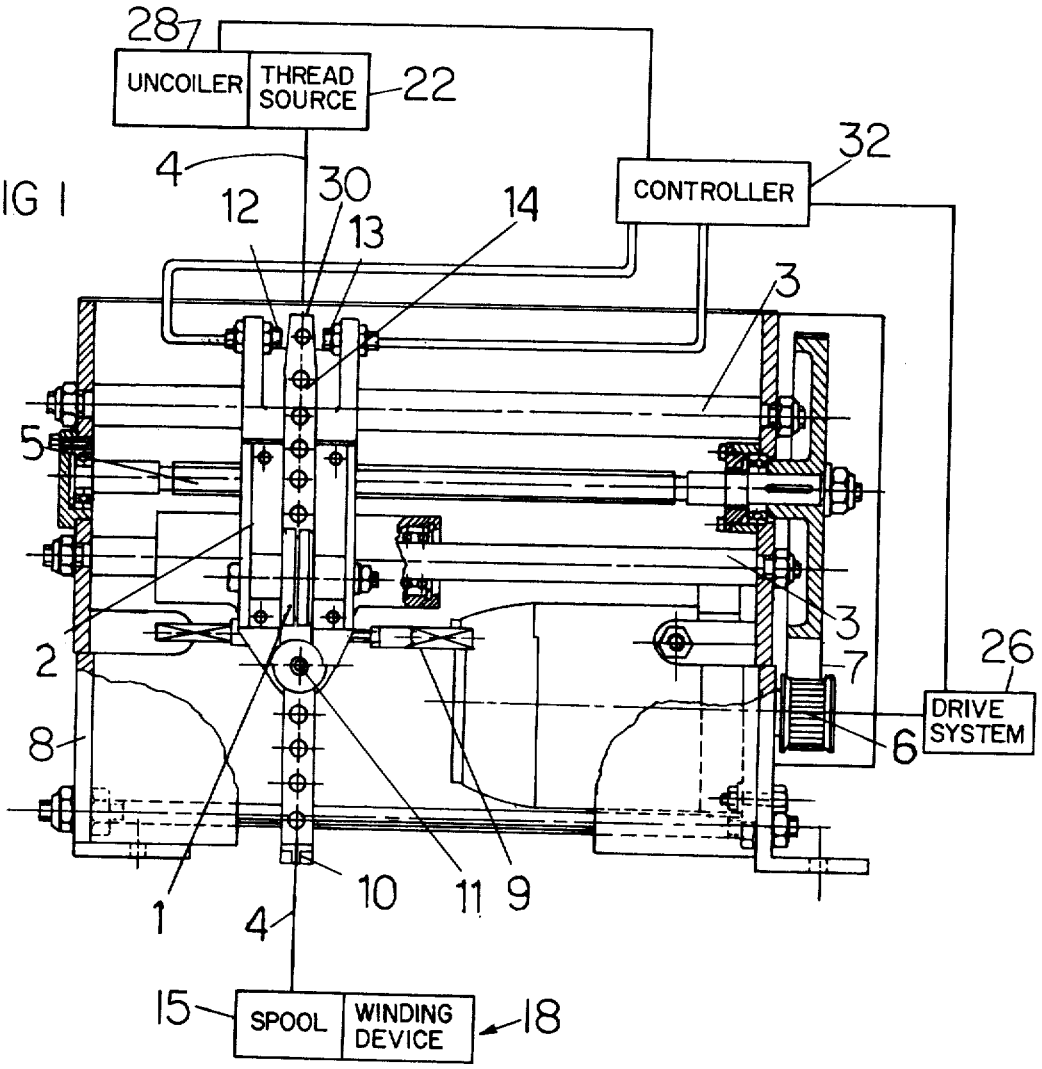
FIG. 1 is a diagram of an arrangement of a machine utilizing the improvements of the present invention.

According to the present invention and with reference to said drawing, a thread guide roller or wheel 1 is carried by a carriage 2. Carriage 2 rolls upon fixed, linear guides 3 and serves as the mounting for a straightening device. A thread 4 from a thread source 22 is wound upon a spool 15 through a feed system which is not represented.

The thread 4 rests upon the guide roller 1, and therefore the roller 1 constitutes a fixed guide and supporting point for the thread between the thread source 22 and spool 15.

One of the purposes of the invention is, as already said, to achieve the winding of the thread turn against turn. This result is achieved by displacing the carriage 2 at a uniform or constant speed across the distance of the width of the winding machine. Once one end of the spool has been reached, the thread and carriage 2 must be able reverse direction to superimpose a successive layer of turns on the series of turns which had previously been laid. In order to achieve a continuous and uniform motion of the carriage 2, and, therefrom, the roller-guide 1 with respect to the winding spool 15, the carriage 2 is suitably engaged with a worm screw 5 driven by means of a suitable transmission device, for instance a gear 6 and a belt 7. This transmission device receives the movement from a motor of a drive system 26, as for instance an oleodynamic or pneumatic system. Through the rotation of the motor of the drive system 26 and through the gear 6 and belt 7, the worm screw 5 will rotate and will drive the carriage 2 and the thread-guiding roller 1 with a constant linear speed, the carriage 2 being able to be displaced axially of spool 15 owing to the guides on which it slides. The sliding motion and driving force may also be obtained by means of an oleodynamic or pneumatic system.

On the frame 8 including the guides at least a motion reversal switch or microswitch 9 is furnished, which may be called an "end-of-stroke" or limit microswitch. Alternatively, photocells may be furnished with transmitters of the LED (Light Emitting Diode) type.

The provision of the end-of-stroke or limit microswitches 9 or of the photocell devices with LEDtype transmitter, are not sufficient to determine with exactness and precision the instant at which the carriage 2 must reverse its movement, that is, the instant at which the motor of drive system 26 or at least the gear 6 and belt 7 must cause the reversal of the direction of rotation of the worm screw 5 so that the carriage 2 will be displaced in a direction opposite to the previous one, and, therefore, the thread 4 will form closely arranged turns upon the previously laid layer of turns.

In order to achieve the exact determination of the instant at which the reversal of the movement must take place, it is necessary to furnish a member or drive able to pick up or detect such data. The data which is utilized, according to the invention, is the displacement or lateral movement of the thread from a right angle relative to the spool 15, when the thread has reached the right or the left end of the spool. In other words, when the thread 4 being wound upon the collecting spool 15 reaches an end of the spool, the thread 4 moves laterally or is slanted relative to its angle at the central position of the spool and, according to the invention, this slant or lateral movement of the thread is detected to determine the instant at which the movement of carriage 2 is reversed. During this reversing phase, the motor of a positively driven uncoiler 28 will receive, for a fraction of time, an electrical braking pulse to avoid the overlapping of the thread and, therefore, help the system to start a faultless winding of the succeeding layer of turns. The start of this reversing phase (one for each side of spool 15) commenced by two photodiode devices which ensure the exactness of intervention.

According to the invention, the pick-up or detection operation is effected by means of a fork 10, schematically represented in FIG. 1. This fork 10 is carried by an elongated lever 14 having its fulcrum at 11 and which, at its opposite free end 30, is able to act upon one or the other of two proximity microswitches 12 and 13 or photocells, suitably arranged. The thread 4 passes through the fork 10, and this fork may be displaced as a consequence of the displacement of the carriage 2 and of the thread 4. As is shown in FIG. 1, the free end 30 extends a sufficient distance from the fulcrum 11 to amplify any motion of the one end carrying the fork 10. During displacement of the fork 10, a pivoting of lever 14 takes place so that the free end 30 of the lever 14 effects a displacement which, at a certain point, will cause it to actuate one of the two microswitches or photocells 12 and 13. The operation of the one or the other of the two microswitches 12 and 13 provides a command or control action through controller 32 to cause the immediate reversal of the rotation of the worm screw 5.

For determining and computing the amount of slant of the thread relative to a straight line which is perpendicular to the spool, the proximity microswitches 12 and 13 may be changed to a potentiometer applied on the fork 10 of the lever 14 controlled by the thread.

It is, therefore, possible to adjust the amount of slant of the thread by acting upon a regulation trimmer which establishes the desired value of slant. The error between said trimmer and the potentiometer, which is mounted upon the lever 14 determines the speed of the motor of the distributor, which in turn will act in such a way as to eliminate the error itself.

Such a movement of carriage 2, has the function of causing the arrangement of a successive layer of turns upon a previously arranged layer of turns.

On the other hand, the action of the fork 10 and the corresponding microswitches or photocells 12 and 13 is essential since the carriage 2 must effect a displacement to effect the superposition of the first turn of the new layer of turns upon the last turn of the previously laid layers and the command to effect this displacement, therefore, could not be directly provided by the microswitches 9 because they provide only an end of stroke or limit indication. Microswitches 9 operate to reverse the carriage 2 if switches 12 and 13 do not so operate.

As it has previously been observed, the point of the reversal of the slant of the winding thread is represented by the point or plane of contact of the thread with the ridge or rim of the one or the other of the side flanges of the spool. To obtain a valid reversal point or plane and keeping in mind that the winding spools are usually made of a plastic material, a solution is provided which is illustrated in FIG. 2.

In this solution, a spool 15 is mounted between two blocking flanges 16 that are supported by a winding device 18. The flanges 16 extend inwardly of or towards the center of the spool. The side walls 19 of the spool 15 are received between the flanges 16 during the winding operation and the flanges 16 have a diameter at least equal to the diameter of the walls 19. The walls 19 thus contained by the flanges 16, are unable to warp outwardly of the spool under the effect of stresses which are imparted to them by the winding thread. It is for that reason that some type of hydraulic or mechanical blocking system or device is absolutely necessary to maintain the flanges in position at the side walls of the spool.

Figure 2:
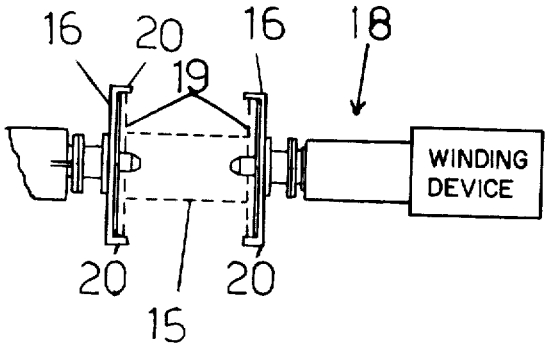
FIG. 2 is schematic view of a blocking system engaging a winding spool on a winding device.

In the solution which is illustrated in FIG. 2, the flanges 16 are so shaped that they are both able to receive the walls 19 and determine the abovementioned point of contact with the thread. In particular, in the illustrated example, the flanges 16 are provided with rims 20 having a thickness which is substantially euqal to the thickness of the walls 19, so that the walls 19 are completely received within the flanges 16. This prevents warping of walls 19 during winding, and also prevents the wear of the rims of the walls 19 because of the rubbing of the thread 4 against them.

Various modifications and variations can be imparted to the above described improvements as it is possible to utilize various forms of control, such as mechanical, electrical, electronic, pneumatic or oleodynamic in order to achieve a faultless synchronization and a perfect reliability of the apparatus through the utilization of the principles of the present invention.

In particular, the motor of the drive system 26 of the thread distributor can be an alternating current motor, and it can be controlled by a transistorized electronic device or by a direct-current device. Likewise, the motor could be changed to another generator of motion or it could receive the motion from a motor for the general system. The movement reversal device could be controlled by suitable means, so that the carriage undergoes a stop at the end of stroke and receives after a very short pre-determined time the impulse which is necessary in order to get the carriage moving in the opposite direction.

I claim:

1. A system for guiding a thread in a winding machine, the thread being fed from a feed source and being wound upon a winding spool of a winding device, the spool having side walls, a center and a longitudinal axis and the thread being wound in the spool in layers of side by side turns laid one on top of another, the system comprising:

a carriage rolling upon fixed, linear guides and being displaceable along the guides in two opposed directions, the guides being arranged parallel to the longitudinal axis of the spool;

drive means for displacing the carriage in the two opposed directions at a substantially continuous speed;

a guide roller carried on the carriage and rotatable in a direction substantially normal to the displacement directions of the carriage, the guide roller engaging with the thread and being rotated by the thread as the thread passes from the feed source to the spool;

an elongate lever pivotally mounted on the carriage, the lever including one end defining a fork through which the thread passes, the fork being arranged between the guide roller and the spool and the lever including another end extending opposite the one end a sufficient distance to amplify any motion of the one end, the lever being pivoted by lateral movements of the thread transmitted through the fork;

detector means located adjacent the other end of the lever for detecting any pivoting of the lever and providing control signals indicating the same;

control means for reversing the displacement of the carriage at the instant of the control signals; and blocking means supported by the winding device of the winding spool, the blocking means including flanges extending inwardly of the spool side walls toward the center of the spool and defining contact planes precisely engageable against the thread as it is wound on the spool adjacent the side walls, the blocking means for imparting lateral movements to the thread when engaged therewith;

so that the lateral movements precisely imparted to the thread at the ends of the spool by the flanges cause a pivoting of the lever through the fork, the amplified movement of the other end of the lever being detected by the detector means and providing control signals indicating the same and the control means reversing the displacement of the carriage at a precise instant to commence the laying of a new layer of turns free of irregular superpositions of turns at the spool sidewalls.

2. The system as claimed in claim 1 in which there are limit switch means located beyond the positions at which reversal of the displacements of the carriage occur for limiting and reversing the displacements of the carriage thereat.

3. The system as claimed in claim 2 in which the switch means include microswitches coupled to the control means and positioned on the frame.

4. The system as claimed in claim 1 in which the drive means include a motor driving a worm screw, the motor being controllable both in its speed and direction of rotation.

5. The system as claimed in claim 1 in which the thread normally forms a right angle with the longitudinal axis of the winding spool and the detector means are arranged relative the other end of the lever to detect a movement of the thread from the right angle.

6. The system as claimed in claim 1 in which the detector means are microswitches.

7. The system as claimed in claim 1 in which the side walls of the spool are formed of a plastic material and have a diameter, and the flanges have a diameter at least as large as the diameter of the side walls and the flanges including rims extending inwardly of and towards the center of the spool, the side walls being received within the rims so that the flanges maintain the side walls stiff during winding and reduce wear on the side wall caused by engagement with the thread.

8. The system as claimed in claim 1 in which there are cushion means coupled to the thread for cushioning stresses in the thread occurring during commencing the laying of a new layer of turns to maintain constant a braking force applied to the thread for every type and diameter of thread.

9. The system as claimed in claim 8 in which the cushion means include an uncoiler motor of the feed source, which, at the instant of the reversal of displacement of the carriage, effects a braking of the thread movement to the spool to assist in commencing the laying of a new layer of turns free of irregular superpositions of turns at the spool side walls.

* * * * *